US005463823A

United States Patent [19]

Bell et al.

[11] Patent Number: 5,463,823

[45] Date of Patent: Nov. 7, 1995

[54] SANDAL HAVING HEEL RETAINING MEANS FOR USE ON OTHER FOOTWEAR

[76] Inventors: Michael Bell, 1705 Triumphe Way, Warrington, Pa. 18976; Jonathan M. Bell, 1500 Locust St., Apartment 3313, Philadelphia, Pa. 19102

[21] Appl. No.: 232,562

[22] Filed: Apr. 25, 1994

Related U.S. Application Data

[63] Continuation-in-part of Ser. No. 121,128, Sep. 14, 1993, Pat. No. 5,359,789.

[51] Int. Cl.[6] ..... A43B 5/00

[52] U.S. Cl. ..... 36/11.5; 36/58.6; 36/7.6

[58] Field of Search ..... 36/11.5, 7.5, 7.6, 36/7.8, 62, 64, 58.5, 7.1 R, 7.1 A, 58.6

[56] References Cited

U.S. PATENT DOCUMENTS

| | | | |
|---|---|---|---|
| D. 131,318 | 2/1942 | Levin . | |
| 395,271 | 12/1888 | Fry et al. | 36/58.6 |
| 962,428 | 6/1910 | Harrold et al. | 36/58.6 |
| 1,032,600 | 7/1912 | Grout . | |
| 2,327,322 | 8/1943 | Slater | 36/11.5 |
| 2,361,972 | 11/1944 | Smith . | |
| 2,399,638 | 5/1946 | Kalnitz | 36/7.6 |
| 2,801,478 | 8/1957 | Gilbert . | |
| 2,825,155 | 3/1958 | Hines | 36/58.6 |
| 2,976,623 | 3/1961 | Gallaway | 36/11.5 |
| 3,214,850 | 11/1965 | McNair . | |
| 3,229,389 | 1/1966 | Adams | 36/62 |
| 3,516,181 | 6/1970 | Jordan . | |
| 4,344,238 | 8/1982 | Peyser . | |
| 4,353,172 | 10/1982 | Bryant . | |
| 4,525,939 | 7/1985 | McNeil et al. . | |
| 4,817,302 | 4/1989 | Saltsman . | |
| 4,843,736 | 7/1989 | Courian | 36/11.5 |
| 4,869,000 | 9/1989 | York, Jr. . | |
| 4,910,883 | 3/1990 | Zock, Jr. . | |
| 4,920,664 | 5/1990 | McGregor et al. . | |
| 5,228,216 | 7/1993 | Sargeant | 36/7.5 |
| 5,359,789 | 11/1994 | Bell | 36/7.6 |

FOREIGN PATENT DOCUMENTS

| | | | |
|---|---|---|---|
| 575736 | 4/1924 | France | 36/11.5 |
| 1244433 | 3/1933 | United Kingdom | 36/11.5 |

*Primary Examiner*—Steven N. Meyers
*Attorney, Agent, or Firm*—Caesar, Rivise, Bernstein, Cohen & Pokotilow, Ltd.

[57] ABSTRACT

An ice-gripping sandal for securement to the sole of a boot or other primary footwear. The sandal comprises a sole and plural attachment straps for mounting the sandal on the boot. The sandal's sole has a bottom surface having plural ice-gripping teeth. The attachment straps are secured to the sole and comprise a short front strap and a long front strap and a pair of short rear straps. The long front strap is arranged to be extended through a loop in the short front strap and about the upper of the boot through loops in the rear straps so that its free end is connected to a buckle mounted on the short front strap at the toe of the boot, thereby forming "figure 8" strap pattern. A pair of cooperating VELCRO® fastening strips are secured onto the long strap to hold the long strap in the buckle. A heel retainer in the form of a projection is located at the rear of the sole of the sandal for frictionally engaging the vertically extending portion of the heel of the primary footwear to aid in holding the sandal in place. The heel retainer includes a top surface which is arranged to be stepped on to facilitate the removal of the sandal from the footwear.

6 Claims, 4 Drawing Sheets

FIG. 3
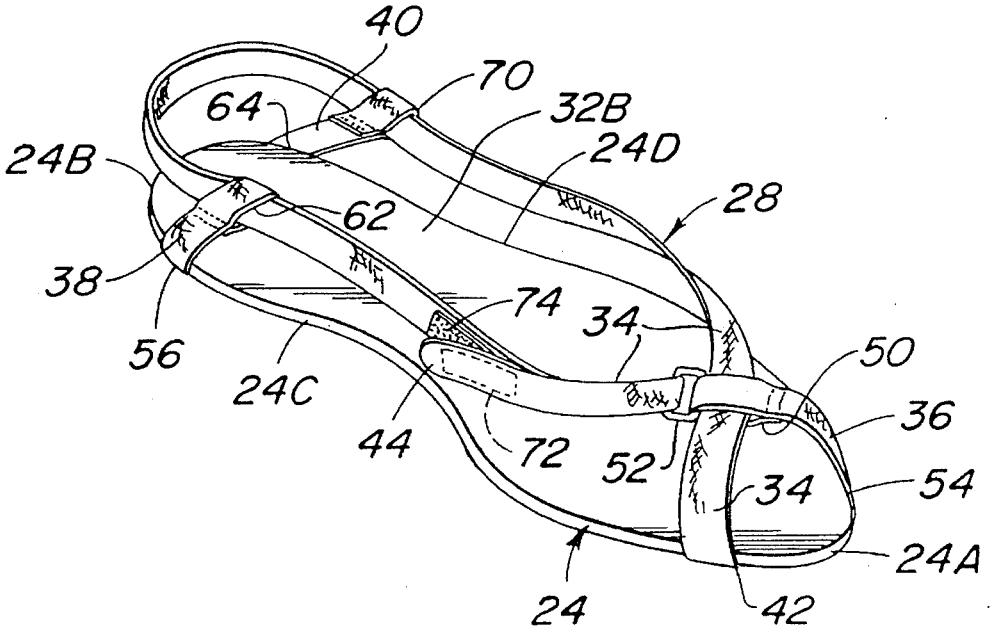
FIG. 4
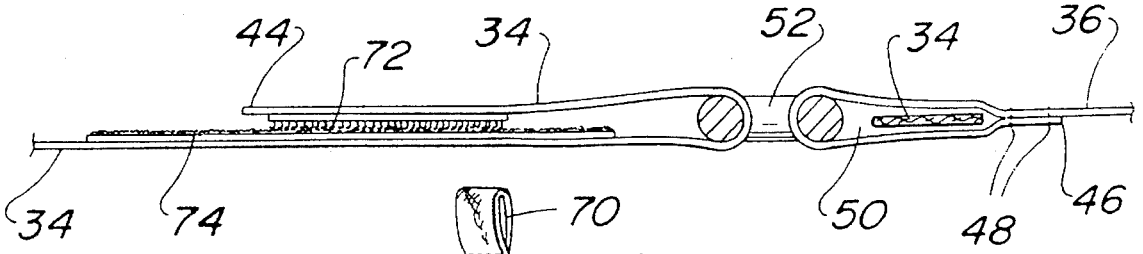
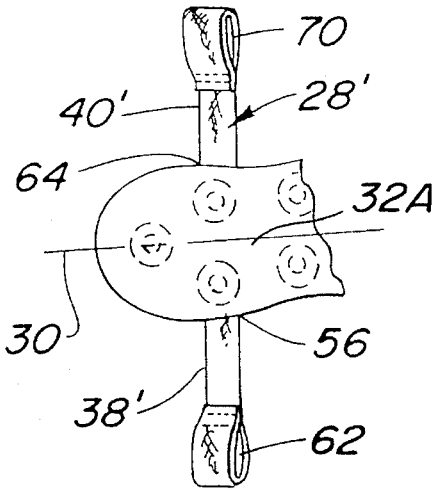
FIG. 5

SANDAL HAVING HEEL RETAINING MEANS FOR USE ON OTHER FOOTWEAR

This application is a Continuation-In-Part of my earlier filed U.S. patent application Ser. No. 08/121,128 now U.S. pat. No. 5,359,789, filed on Sep. 14, 1993, entitled Ice Gripping Sandal For Use On Other Footwear, whose disclosure is incorporated by reference herein, and the invention hereof relates generally to footwear, and more particularly to attachments in the form of a sandal which is adapted to be worn over other footwear to render it resistant to slippage on ice or snow.

BACKGROUND OF THE INVENTION

Various ice gripping, sandal-like, attachments for footwear are commercially available and have been disclosed in the patent literature. Examples of such patented devices are found in the following U.S. Pat. Nos.: 1,032,600 (Grout); 2,361,972 (Smith); 3,214,850 (McNair); 3,516,181 (Jordan); 4,344,238 (Peyser); 4,353,172 (Bryant); 4,525,939 (McNeil et al.); and 4,910,883 (Zock, Jr.). While the devices disclose in those patents appear generally suitable for their intended purposes, they never the less appear to leave something to be desired from various standpoints, such as simplicity of construction, ease of mounting, removing, and adjusting.

Various sandals with means for enabling the adjustment of their mounting straps have been disclosed in the patent literature, such as the following U.S. Pat. Nos.: Des. 131,318 (Levin); 2,801,478 (Gilbert); 4,817,302 (Saltsman); 4,869,000 (York); and 4,920,664 (McGregor et al.). However, none of these sandals discloses a strapping arrangement which could be used with an ice gripping sole to obviate the disadvantages of the prior art ice gripping sandals. Moreover none of these sandals include means to assist in retaining the heel portion of the primary footwear on the sandal or means to assist in removing the sandal from the footwear.

OBJECTS OF THE INVENTION

Accordingly, it is a general object of this invention to provide a sandal which overcomes the disadvantages of the prior art.

It is another object of this invention to provide a sandal having a non-slip, e.g., ice gripping, sole and which includes mounting straps constructed so that the sandal can be easily mounted onto the sole of any type of primary footwear.

It is yet another object of this invention to provide a sandal having a non-slip, e.g., ice gripping, sole and which includes retaining means for ensuring that once the sandal is mounted onto the sole of the primary footwear the heel portion of the primary footwear will remain in place with respect to the sandal's sole.

It is still another object of this invention to provide a sandal having a non-slip sole and which includes mounting straps constructed so that the sandal can be easily removed from the sole of any type of primary footwear.

It is still another object of this invention to provide a sandal having a non-slip sole and which includes retaining means for facilitating the retention of the heel of the primary footwear on the sole, when desire, yet which can be operated to facilitate the removal of the primary footwear from the sandal, when desired.

SUMMARY OF THE INVENTION

These and other objects of this invention are achieved by providing a sandal. In accordance with one aspect of the invention the sandal is arranged for attachment to the sole of a primary footwear to provide a desired gripping function.

The sandal comprises a sole and attachment strap means secured to the sole for attaching the sandal to the primary footwear.

The sole of the sandal has a pair of sides, a front end, a rear end. The attachment strap means comprises a first flexible strap connected to the front end of the sandal's sole adjacent one of the sides, a second flexible strap connected to the front end of that sole adjacent the other of the sides, a third strap having an opening therein connected to the rear end of that sole adjacent one of the sides, and a fourth strap having an opening therein connected to the rear end of that sole adjacent the other of the sides.

One of the first or the second straps has a free end at which a buckle is mounted. The other of the first or the second straps is an elongated member having a free end arranged to be extended to the opposite side of the sandal's sole from which it is connected, extended around the primary footwear and through the openings in the third and fourth straps, back to the side of the sole from which it is secured, and from there through the buckle of the one of the first or second straps, to releasable secure the free end of the other of the first or second straps to the one of the first or second straps.

In accordance with one preferred embodiment of this invention the sole includes a plurality of ice gripping projections or teeth extending therefrom to provide the wearer with protection against slipping on icy surfaces.

In accordance with another aspect of this invention the sandal comprises a sole, heel retaining means, and sole attachment strap means. The sole has a pair of sides, a front end, a rear end, a top surface, and a ground engaging bottom surface. The primary footwear includes a heel having a generally vertically disposed surface. The primary footwear is disposed on the top surface of the sandal's sole. The attachment strap means comprising plural flexible straps connected to the front end and rear end to form a generally figure-8 configuration having a forward loop and a rear loop, with the toe portion of the footwear disposed in the forward loop and with the ankle portion of the footwear being disposed within the rear loop to hold said sole on the primary footwear.

The heel retaining means comprising a member projecting upward from the top surface of the sole at the rear end thereof for frictionally engaging a portion of the generally vertical rear surface of the heel portion of the sole of the primary footwear to provide additional means for retaining said heel portion of the primary footwear in engagement with the top surface of the sole.

In accordance with another preferred embodiment of this invention the heel retaining means comprises a flanged surface, suitable to be stepped on to hold the sandal in place to facilitate its removal from the primary footwear.

DESCRIPTION OF THE DRAWINGS

Other objects and many attendant features of this invention will become readily appreciated as the same becomes better understood by reference to the following detailed description when considered in connection with the accompanying drawings wherein:

FIG. 3 is an isometric view of the sandal shown in FIG. 1 shown with its strap assembly connected in the same manner it is used to secure the sandal to the boot;

FIG. 4 is an enlarged sectional view taken along line 4—4 of FIG. 1;

FIG. 5 is a top plan view of a portion of an alternative strap assembly for a sandal constructed in accordance with this invention;

DETAILED DESCRIPTION OF THE PREFERRED EMBODIMENTS

Figure 1:
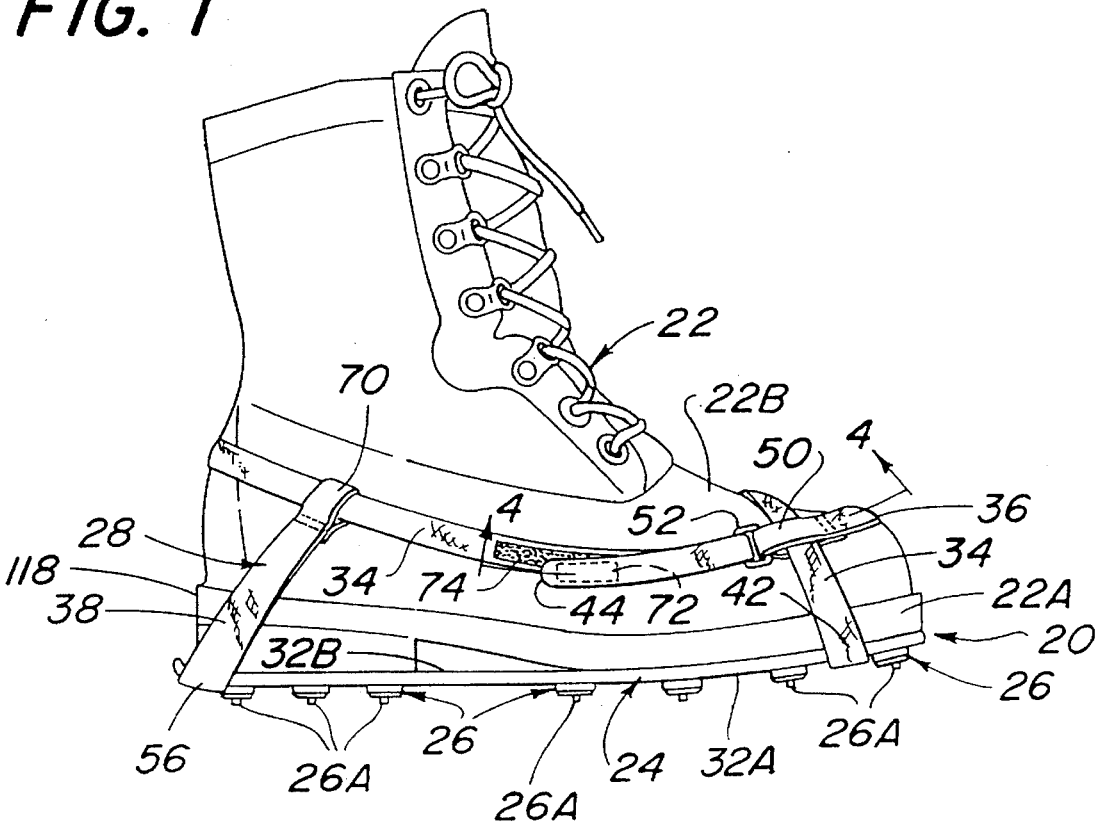
FIG. 1 is a side elevational view of a conventional boot having an ice-gripping sandal constructed in accordance with this invention secured to the boot by the sandal's strap assembly to provide slip resistance for icy surfaces.

Referring now to various figures of the drawing where like reference numerals refer to like parts there is shown at 20 in FIG. 1, a sandal constructed in accordance with this invention for securement to any type of conventional footwear 22, e.g., a boot, having a sole 22A and an upper 22B, to render the it resistant to slippage on slippery surfaces. In accordance with a preferred embodiment of this invention the sandal is particularly suited for providing slip resistance on ice. To that end the sandal 20 basically comprises a sole 24, having plural ice gripping projections 26, and one of two types of strap assemblies 28 (FIGS. 1–3) or 28' (FIG. 5).

The strap assemblies 28 and 28' will be described in detail later. Suffice it for now to state that they are identical in function and quite similar in construction. Each strap assembly comprises a plurality of elongated strap members which are secured to the sole 24 and which cooperate with one another to enable the sandal 20 to be mounted on the boot 22 so that the sole 24 of the sandal is disposed under the sole 22A of the boot 22 as shown in FIG. 1. The only difference in construction between the sandal's strap assemblies 28 and 28' is the angle at which certain strap members of those assemblies are secured to the sandal's sole.

The sole 24 of the sandal can be of any conventional or non-conventional type of construction of any suitable material, leather, rubber, plastic, etc., so long as it extends for the entire length and width of the sole 22A of the primary footwear, e.g., the boot 22, on which it is to be disposed. Thus, as can be seen clearly in FIG. 2 the sole 24 of the sandal 20 includes a front end 24A, a rear end 24B, and a pair of sides, namely, a medial side 24C and a lateral side 24D. The pair of sides 24C and 24D are located on opposite sides of the sole's longitudinal axis 30.

The underside 32 of the sandal's sole includes the heretofore mentioned ice gripping projections 26. These projections are either fixedly secured or releasably secured, e.g., threadedly mounted, to the underside of the sole 24 so that they are spread out over most of the expanse of the sole, except for its arch portion. However, if desired, some projections 26 may also be located in the arch area as well. In any case, the projections are preferably of any conventional construction, e.g., metal spikes or prongs. Each spike or prong includes a pointed free end 26A arranged to penetrate into the ice to grip it. Instead of the underside of the sandal's sole being flat, as shown in the drawings, it may be constructed to include plural angularly cleats in the forefoot region and transversely extending cleats in the heel region like those disclosed in the sole of the boot disclosed in my U.S. Pat. No. 4,329,790, whose disclosure is incorporated by reference herein. Preferably, plural ice gripping projections 26 are located in the angularly extending cleats in the forefoot region and in the transversely extending cleats in the heel region to provide maximum gripping action on ice.

Figure 2:
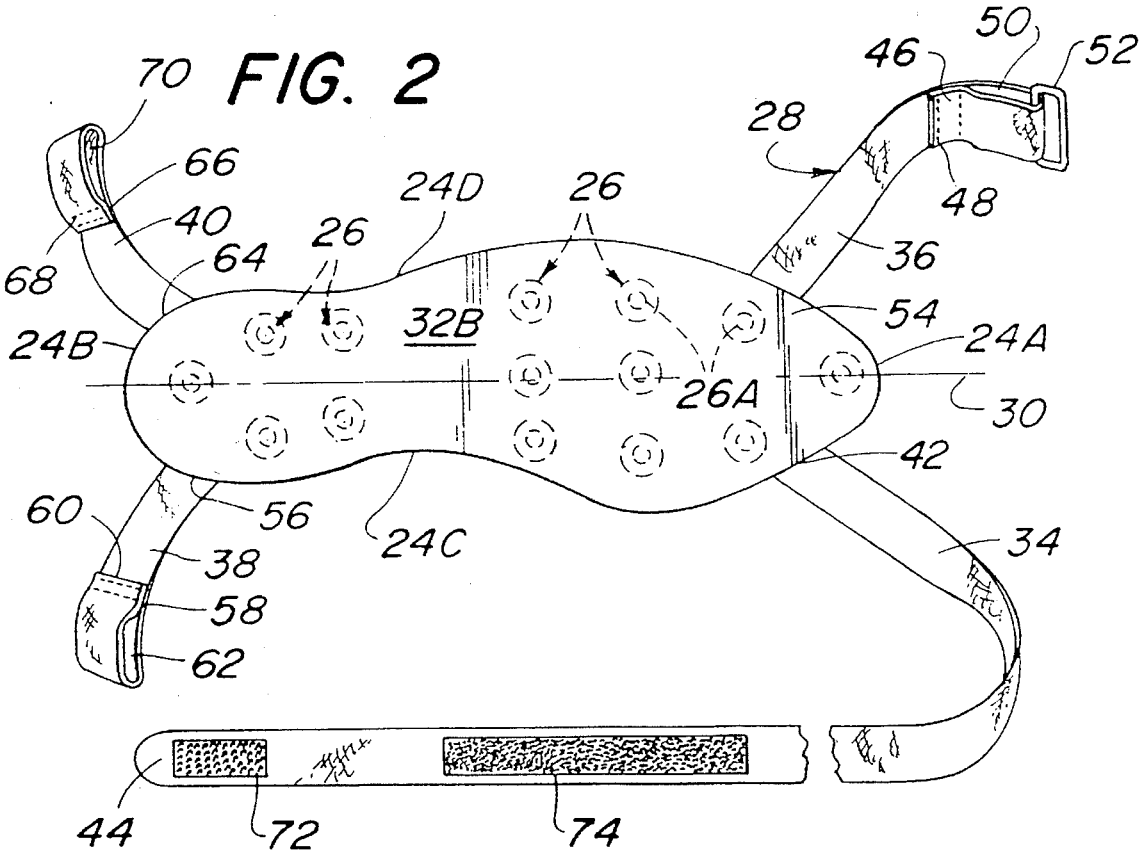
FIG. 2 is a top plan view of the sandal shown in FIG. 1, with its strap assembly laid flat so that it is disconnected.

Referring now to FIGS. 2–3 the details of the strap assembly 28 for attaching the sandal 20 to the boot 22 will now be described. That assembly basically comprises a pair of front attachment straps 34 and 36, and a pair of rear attachment straps 38 and 40. Each of the straps is an elongated flexible member formed of any suitable material, e.g., leather, rubber, a plastic. The front strap 34 is a relatively long member, for reasons to be described later, and includes one end 42 which is fixedly secured to the side 24C of the sole adjacent the front end 24A. The free end 44 of the strap 34 is arranged to be extended about the boot and releasably secured to the front strap 36 in a manner to be described later.

The front strap 36 is substantially shorter than the other front strap 34 and includes a free end 46 which is bent back over itself and stitched at 48 to form a loop 50. A buckle in the form of a ring 52 of rectangular profile, and of any suitable material, e.g., metal or plastic, is held within the loop 50 to fixedly secure it onto the free end of the strap. The other end 54 of the strap 36 is fixedly secured to the side 24D of the sole 24 adjacent the front end 24A. In accordance with both embodiments of the strap assemblies 28 and 28' the front straps 34 and 36 oriented so that each extends to the side and frontward at an acute angle, e.g., approximately 45 degrees, to the longitudinal axis 30 of the sole 24.

The buckle 52 on the strap 36 is provided as a means to enable the free end of that strap to be releasably secured to front strap 34, as will be described later.

The rear straps 38 and 40 are of identical construction. Thus, as can be seen the rear strap 38 includes one end 56 which is fixedly secured to the sole 24 at the side 24C adjacent the rear end 24B so that it extends to the side and backward at an acute angle, e.g., 45 degrees to the longitudinal axis 30. The other or free end 58 of the strap 38 is bent back over itself and stitched at 60 to form a loop 62. The strap 40 includes an end 64 which is fixedly secured to the sole 24 at the side 24D adjacent the rear end 24B so that the strap 40 extends to the side and backward at an acute angle, e.g., 45 degrees to the longitudinal axis 30. The other or free end 66 of the strap 40 is bent back over itself and stitched at 68 to form a loop 70. It is through the loops 70 and 62 of the rear straps 40 and 38, respectively, and through the loop 50 of the front strap 36 that the long front strap 34 is extended to connect the straps together as shown in FIG. 3.

The sandal is arranged to be easily and quickly mounted on the boot. In particular, in order to secure the sandal 20 to the boot 22 the sole of the boot is disposed on the inner surface 32B of the sandal's sole (like shown in FIG. 1). The rear straps 38 and 40 are bent or extended upward and forward from the laid-flat position shown in FIG. 2 so that they lie on their respective sides of the rear of the boot (like shown in FIG. 1). The shorter front strap 36 is then bent upward and rearward from the laid-flat position to an extended position (shown in FIGS. 1 and 3). In the extended position the strap 36 extends over the toe of the boot so that the loop 50 at the free end is located adjacent the side 24C of the sandal. The longer front strap 34 is then bent or extended upward from the laid-flat position and threaded through the loop 50 in the strap 36, over the toe of the boot around the opposite side of the boot through the loop 70 at the free end of the rear strap 40, around the heel of the boot, through the loop 62 at the free end of the rear strap 38, along the contiguous side of the boot, and through the buckle 52 at the free end of the strap 36 (as shown in FIG. 1).

As can be seen clearly in FIGS. 2 and 4 the free end of the long front strap 34 includes a pair of cooperating hook and loop fastener, e.g., VELCRO ® brand fastener, patches 72 and 74 fixedly secured on the outside of the strap and spaced apart from each other. The hook patch 72 is located closer to the free end of the strap 34 than the loop patch 72. Thus, when the free end 44 of the longer front strap 34 is threaded through the buckle and pulled backwards, as shown in FIGS. 1 and 3, it tightens the strap assembly on the boot. In particular, the VELCRO® hook patch 72 releasably engages the VELCRO® loop patch 74 to prevent the strap assembly from loosening. This action hold the sandal securely in place on the boot.

When it is desired to remove the sandal from the boot all that is required is to peel the engaging VELCRO® patches 72 and 74 from each other to enable the free end 44 of the longer front strap 34 to be loosened or removed from the interior of the buckle 52. Either action effectively loosens the strap assembly, thereby permitting the sandal to be readily removed from the boot.

The strap assembly 28 is arranged so that it can be left in a partially connected configuration, i.e., the longer strap extending through the loops 50, 70, and 62 of the straps 36, 40, and 38, respectively, so that it is available for remounting on the boot with even less manipulation and effort than required to initially mount it thereon from the laid-flat strap configuration shown in FIG. 2.

In FIG. 5 the rear portion of a sandal utilizing an alternative strap assembly 28' is shown in the laid-flat configuration. As mentioned earlier the only difference between that strap assembly and the strap assembly 28 is the fact that in this alternative assembly the rear straps 38' and 40' each extend generally perpendicularly to the longitudinal axis 30 of the sandal's sole. Thus, when the rear straps 40' and 38' are bent upward they lie closer to the heel of the boot for receipt of the longer strap 34 through their loops 70 and 62.

Figure 8:
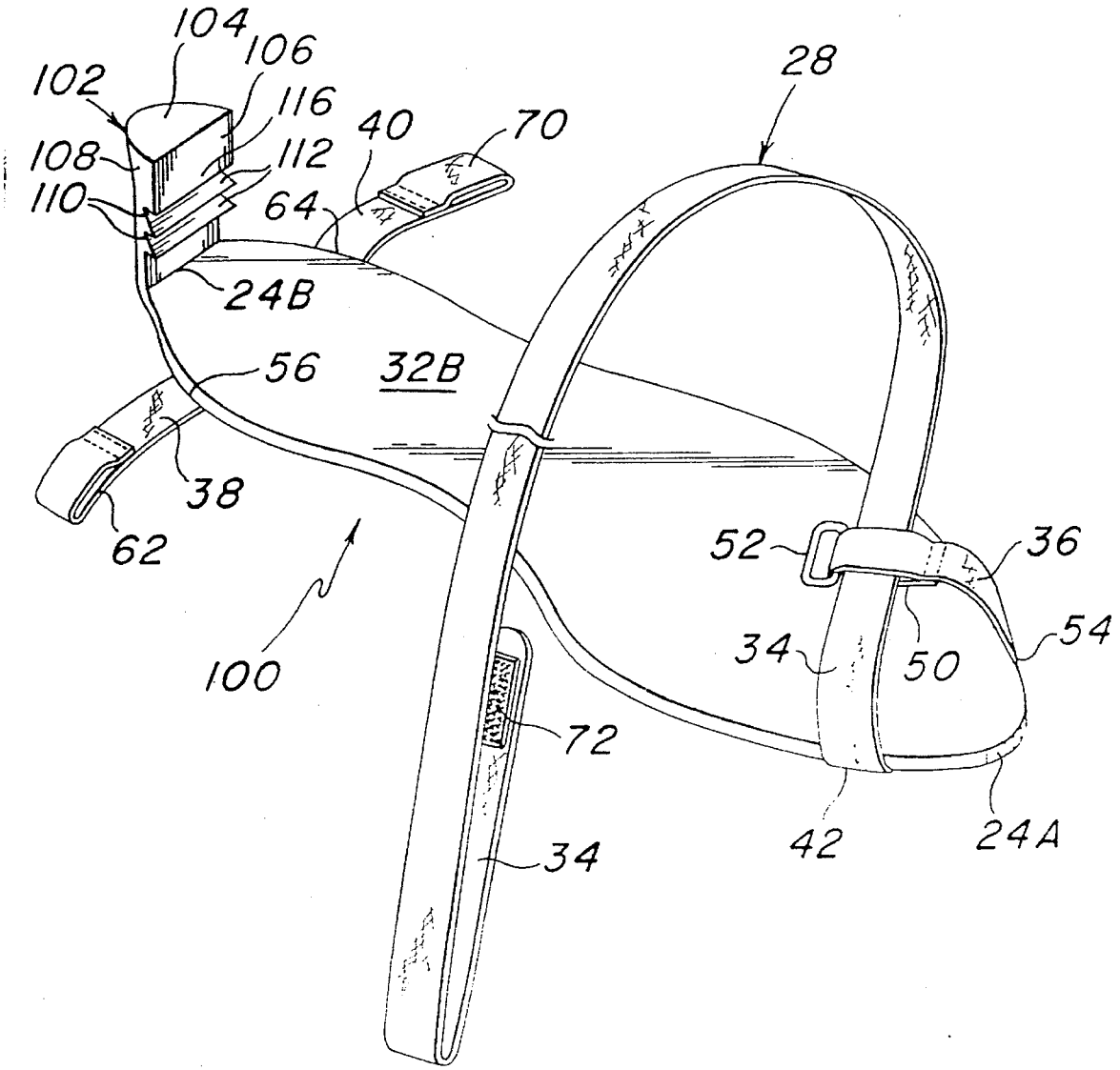
FIG. 8 is an enlarged isometric view of the embodiment of the sandal shown in FIG. 6.

In either embodiment when the strap assembly is connected the straps 34 and 36 together define a "figure 8" shaped configuration, with the toe of the boot 22 being located within one of the openings of the "8" and with the ankle portion of the boot being located within the other opening thereof. This arrangement is quite effective for securely holding the sandal in place on the boot, yet enables its ready dismounting and remounting, when desired.

Figure 6:
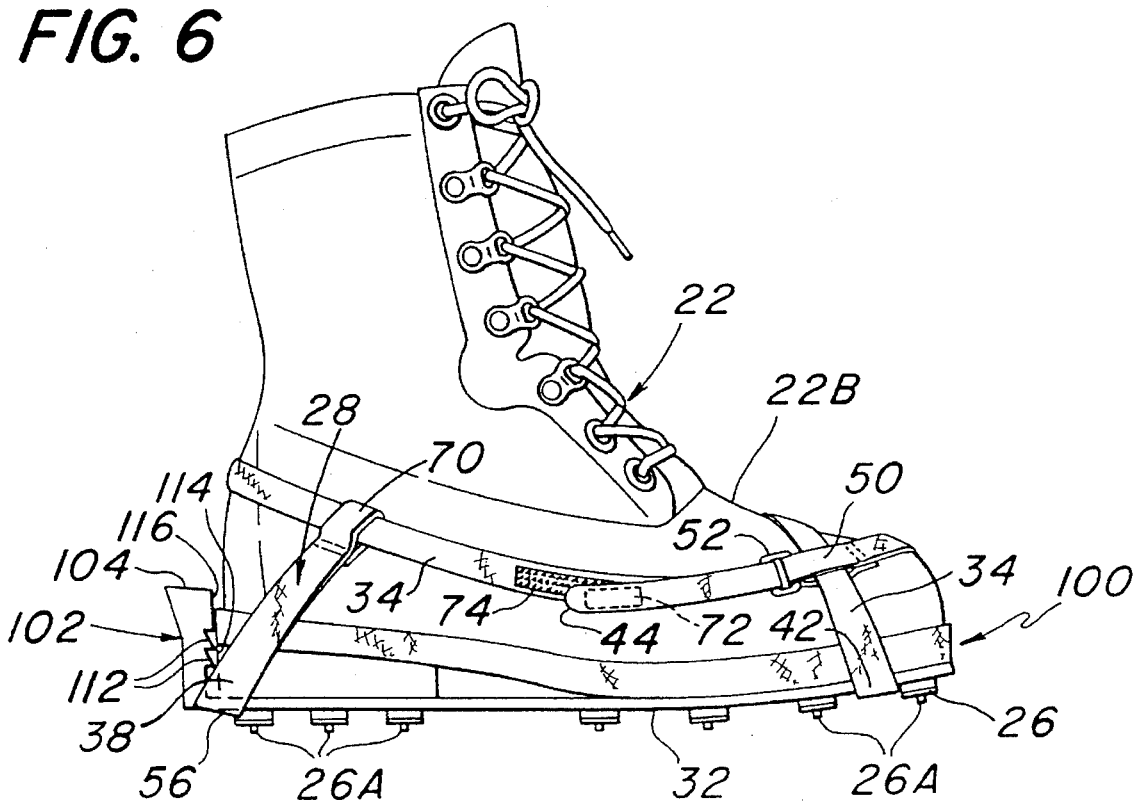
FIG. 6 is a view similar to FIG. 1 but showing another alternative embodiment of this invention.
Figure 7:
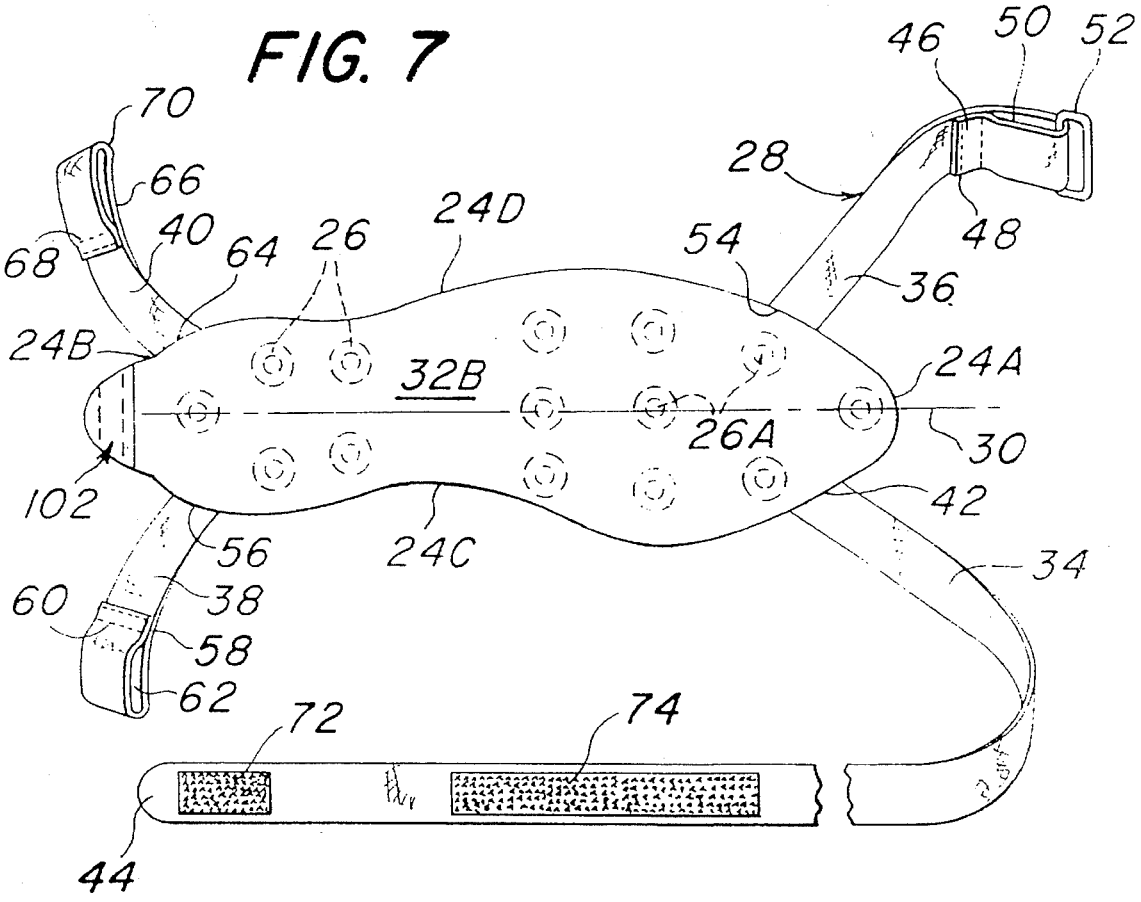
FIG. 7 is a view similar to FIG. 2 but showing the embodiment of the sandal shown in FIG. 6.

Referring now to FIGS. 6–8 there is shown an alternative embodiment 100 of the sandal of this invention. The sandal 100 is in all material respects the same as that described heretofore, except that it includes a heel retaining means and sandal removal facilitating means. Such means are in the form of a projection 102 projecting upward from the top surface 32B of the sandal's sole 24 at the rear end 28B thereof. In accordance with a preferred embodiment of this invention the projection 102 is formed integrally with the sole, e.g., molded as a unit of the same material as that of the sole.

The projection 102 includes a generally planar top surface 104, a generally planar inner surface 106, and an arcuate rear surface 108. The inner surface 106 includes plural recesses 110 to form therebetween plural wedge shaped fingers 112 which project toward the front of the sandal and are disposed generally parallel to each other and to the top surface 32B of the sole 24.

As can be seen clearly in FIG. 6, when the sandal 100 is in place the wedge shaped fingers 112 frictionally engage the vertical rear surface 114 of the heel of the primary footwear, e.g., boot 22. Moreover, the top portion 116 of the vertically oriented inner surface 106 of the projection 102 also frictionally engages the vertical rear surface 114 of the primary footwear's heel. This action has the effect of retaining the primary footwear 22 in place on the sandal 100, i.e., the bottom of the heel of the primary footwear is retained in contact with the top surface 34B of the sandal's sole 24. Since the projection is integrally formed with the sandal's sole it is somewhat resilient so that it can be pivoted or flexed rearwardly slightly to enable the primary footwear to be readily inserted onto the top surface 32B of the sole of the sandal, and then the projection 102 can be released so that its fingers 112 and upper surface 116 frictionally engage the vertically oriented rear surface 114 of the primary footwear's heel. The strap assembly 28, as described heretofore, can then be extended about the upper of the footwear to connect the sandal to it.

The top surface 104 of the projection 102 serves as a convenient step upon which the other foot or ones hand can be placed to pivot or flex the projection 102 slightly to the rear, thereby releasing the frictional engagement between the projection and the primary footwear's heel. The straps of the assembly 24 can be undone either prior to or after the frictional engagement between the projection 102 and the primary footwear's heel has been accomplished. In any case once the straps are disconnected and the projection 102 pivoted or flexed backward slightly to release the frictional engagement therebetween, continued pressure on the top surface 104 of the projection 102 will tend to hold the sandal in place on the ground, whereupon the primary footwear can be readily removed by merely lifting it from the sandal.

It should be pointed out at this juncture that while the sandal of this invention has particular utility when worn over primary footwear, the sandal need not be used in that manner. Thus, the sandal of this invention can be used as primary footwear, i.e., worn directly on the foot. In fact the sandal need not be constructed to include an ice-gripping bottom surface. Thus, it is contemplated that sandals constructed in accordance with this invention can be worn as primary footwear or over primary footwear and can include soles of any type of construction.

Without further elaboration the foregoing will so fully illustrate my invention that others may, by applying current or future knowledge, adapt the same for use under various conditions of service.

We claim:

1. A sandal for use in combination with a primary footwear having a non-slip sole formed of a heel portion and a sole portion, the heel portion of the sole of the primary footwear having a generally vertically oriented rear surface, said sandal comprising a sole, heel retaining means, and sole attachment strap means, said sole of said sandal having a ground engaging bottom surface, a top surface, and a rear end, said sandal being arranged to receive the primary footwear disposed on said top surface of said sole, said attachment strap means comprising plural flexible straps connected together so that they are arranged to hold the primary footwear on said sandal, said heel retaining means of said sandal comprising a member projecting upward from said top surface of said sole of said sandal at the rear end thereof and including surface portions shaped to frictionally engage a portion of the generally vertical rear surface of the heel portion of the sole of the primary footwear to provide additional means for retaining the heel portion of the primary footwear in engagement with the top surface of said sole of said sandal, said heel retaining member additionally comprising a flanged surface, arranged to be pressed on to hold the sandal in place while releasing the frictional engagement between said heel retaining member of said sandal and the heel of the primary footwear to facilitate the removal of said sandal from the primary footwear.

2. The sandal of claim 1 wherein said flanged surface is disposed generally horizontally and comprises the top surface of said heel retaining means.

3. The sandal of claim 1 wherein said sole comprises a non-slip bottom surface.

4. The sandal of claim 3 wherein said non-slip bottom surface comprises plural ice gripping projections extending therefrom.

5. The sandal of claim 1 wherein said sole of said sandal additionally comprising a pair of sides, and a front end, said plural flexible straps of said sole attachment strap means being connected together to said front end and rear end of said sandal to form a generally figure-8 configuration having a forward loop and a rear loop, with the toe portion of the primary footwear disposed in said forward loop and with the ankle portion of the primary footwear being disposed within said rear loop to hold said sole of said sandal against the sole of the primary footwear, said sole attachment strap means comprises a first flexible strap connected to said front end of said sole of said sandal adjacent one of said sides, a second flexible strap connected to said front end of said sole of said sandal adjacent the other of said sides, a third strap having an opening therein connected to said rear end of said sole of said sandal adjacent one of said sides, and a fourth strap having an opening therein connected to said rear end of said sole of said sandal adjacent the other of said sides, one of said first or second straps having a free end at which a buckle is mounted and an opening located adjacent said buckle for receipt of the other of said first or second straps extending therethrough, the other of said first or second straps being an elongated member having a free end arranged to be extended through said opening over the toe portion of the primary footwear to the opposite side of said sole of said sandal from which it is connected, around the upper of the primary footwear at the heel portion and through said openings in said third and fourth straps, back to the side of said sole of said sandal from which it is secured and from there through the buckle of said one of said first or second straps, to releasable secure said free end of said other of said first or second straps to said one of said first or second straps, whereupon said sole attachment strap means secures said sandal to the primary footwear at the toe portion and at the heel portion.

6. The sandal of claim 5 wherein said other of said first or second straps includes a first strip of one component of a releasably securable hook and loop fastening system fixedly secured thereto and a second strip of the other component of said releasably securable hook and loop fastening system fixedly secured thereto and spaced from said first strip, said first and second strips being arranged to releasably engage each other when said free end of said other of said first or second straps is extended through said buckle.

* * * * *